United States Patent [19]

Fisher

[11] Patent Number: 4,854,450

[45] Date of Patent: Aug. 8, 1989

[54] BLISTER PACKAGE

[75] Inventor: Brian A. Fisher, Burlington, Canada

[73] Assignee: Tridon Limited, Oakville, Canada

[21] Appl. No.: 41,063

[22] Filed: Apr. 22, 1987

[30] Foreign Application Priority Data

Apr. 24, 1986 [CA] Canada ..... 507541

[51] Int. Cl.[4] ..... B65D 73/00

[52] U.S. Cl. ..... 206/469; 206/459; 206/461; 206/634; 206/806

[58] Field of Search ..... 206/461, 462, 463, 464, 206/466, 471, 469, 470, 45.24, 45.31, 45.33, 621, 633, 626, 634, 806, 630, 467, 459

[56] References Cited

U.S. PATENT DOCUMENTS

| | | | |
|---|---|---|---|
| 2,892,541 | 6/1959 | Hahn | 206/470 |
| 2,993,590 | 7/1961 | Denton | 206/469 |
| 3,121,493 | 2/1964 | Snape | 206/469 |
| 3,165,239 | 1/1965 | Conklin et al. | 206/806 X |
| 3,255,880 | 6/1966 | Grossman | 206/469 |
| 3,428,171 | 2/1969 | Blish | 206/469 |
| 3,476,239 | 11/1969 | Jacob | 206/459 X |
| 3,756,398 | 9/1973 | Green et al. | 206/461 X |
| 3,942,640 | 3/1976 | Hellstrom | 206/469 |
| 4,091,927 | 5/1978 | Lunsford | 206/459 |
| 4,165,805 | 8/1979 | Fethke et al. | 206/471 X |
| 4,266,666 | 5/1981 | Kuchenbecker | 206/461 |

FOREIGN PATENT DOCUMENTS

| | | | |
|---|---|---|---|
| 2224924 | 12/1973 | Fed. Rep. of Germany | 206/387 |
| 2729808 | 1/1979 | Fed. Rep. of Germany | 206/806 |
| 2460858 | 3/1981 | France | 206/463 |
| 951214 | 3/1964 | United Kingdom | 206/469 |

*Primary Examiner*—Stephen Marcus
*Assistant Examiner*—Bryon Gehman
*Attorney, Agent, or Firm*—Rogers & Scott

[57] ABSTRACT

The invention provides a package having a transparent blister defining a main cavity and a peripheral flange lying in a plane about the cavity. A substrate is attached to the blister so as to close the cavity with the product lying between the blister and the substrate.

A laminated substrate having a first layer attached permanently to the flange and a second layer is provided. The first layer has an area printed with information to be retained for use by a purchaser after opening the package, and a score line penetrates the first layer at the edge of this area. When the package is opened the substrate is delaminated about the area and the score line interrupts the delamination leaving this area attached to the second layer and available intact for inspection by the user.

The package also has a header portion embodying several features which minimize the risk of damage to the package that would detract from its appearance. These features include reinforcement of the header by means of buttresses integral with the cavity, a hole for receiving a hanger formed by cut-outs in the substrate and blister in which the substrate cut-out is larger than the blister cut-out, and corners where the blister and substrate have differing radii, the radius of the corners of the substrate being larger than in the blister so that the blister extends outwardly beyond the substrate.

16 Claims, 4 Drawing Sheets

BLISTER PACKAGE

This invention relates to packaging for displaying products in retail stores and more particularly to blister packages containing a transparent blister attached to a substrate and defining a cavity containing a product.

It has become common to package products for sale at the retail level between a transparent blister and a substrate attached to the blister and capable of receiving printed graphics. The substrate also combines with the blister to define an opening for suspending the package from a wall hanger so that the packages are available for visual inspection by potential purchasers.

The blister is vacuum formed from a transparent plastic sheet and then the product is laid in a cavity formed in the blister before the substrate is added to seal the blister and retain the product in the package. There is commonly no means provided for inspecting the actual product other than by a visual inspection through the blister. The user purchases the product in the package and then separates the product from the package after purchase. This separation is made possible by providing a laminated substrate which can be destroyed to provide access to the product.

The material of the blister must be kept to a minimum to reduce costs and it is therefore essential to design the blister in such a way that it will retain its shape and provide an attractive appearance yet use a minimum of material. The wall consequently have to be designed in such a way that although thin, they nevertheless maintain their shapes against minor impacts.

Another consideration is that the overall package must retain a desirable appearance for its shelf life. This appearance can be affected by such things as separation of the blister from the substrate locally at corners of the package as well as by deformation of the portion of the package around the opening from which it is suspended or by rupture and puncture of the package caused by impact of the product on the blister walls. Such impacts are particularly damaging where the portion of the product which rests against the blister has sharp edges. Characteristically, such damaging impacts occur when a product on display is accidentally dropped by a consumer or falls from the display wall. Also similar damage can result from careless handling of the cartons transporting the packaged products prior to delivery.

Such damaging deformation sullies the overall appearance of the package which then looks like an old product that has been on the shelf for a long time. A consequence of this is often that the product is left on the shelf because the purchaser prefers to select other products in undamaged packages. The retailer is then left with a product which has to be sold at a discount.

It is also common practice to print instructions on an outer surface of the substrate and to use the opposite or inner surface of the substrate for graphics. While this ensures that the user can read the instructions before opening the package, it leaves only limited space for graphics because of the area of substrate covered by the product. A more desirable alternative would be to use the outer surface for graphics and the inner surface for instructions to be read after opening the package. Unfortunately this approach has been unacceptable because the nature of the package is such that the substrate is torn to open it and the instructions then appear on several pieces of the substrate. The user has then to put the pieces together to read the instructions. This is clearly undesirable and it would improve consumer relations if the user were not confronted with the irritating chore of reconstructing the instructions.

As a result of the foregoing disadvantages it has become evident that there are design criteria which blister packages should meet. Firstly it is well accepted that the substrate should be covered entirely by the blister because the shiny finish of the blister enhances both the appearance of the product and the appearance of the package. This fresh look should be maintained while the package is on display, and to ensure this, the package should withstand damaging forces which could cause delaminations with resulting general dilapidation of the package. Also, the blister should have sufficient strength that it will withstand minor impacts and will not collapse or, if deflected, will rebound to its original shape. Lastly, it is preferable to put the graphics on the outer surface of the substrate provided that instructions printed on the inner surface of the substrate are available without damage for the user regardless of how the package is opened.

With these criteria as a basis, the present invention has been developed to address the problems of blister packaging generally. Accordingly, in one of its aspects, the invention provides a package having a transparent blister defining a main cavity for containing a product and a peripheral flange lying in a plane about the cavity. A laminated substrate having a first layer attached permanently to the flange and a second layer is provided. The first layer has an area printed with information to be retained for use by a purchaser after opening the package, and a score line penetrates the first layer at the edge of this area. When the package is opened the substrate is delaminated about the area and the score line interrupts the delamination leaving this area attached to the second layer and available intact for inspection by the user.

According to other aspects of the invention, the header, from which the package is suspended, is strengthened and corners of the substrate are protected to avoid damage.

According to a further aspect of the invention, the blister includes a shock absorbing structure having at least one fold in a portion of the blister so as to divide the cavity into a primary pocket containing the product and at least one secondary pocket which is empty.

These and other aspects of the invention will be better understood with reference to the drawings, in which.

Figure 4A:
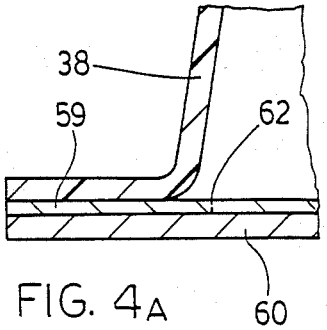
FIG. 4 (drawn adjacent FIG. 1) is a sectional view on line 4—4 of FIG. 3.
Figure 1:
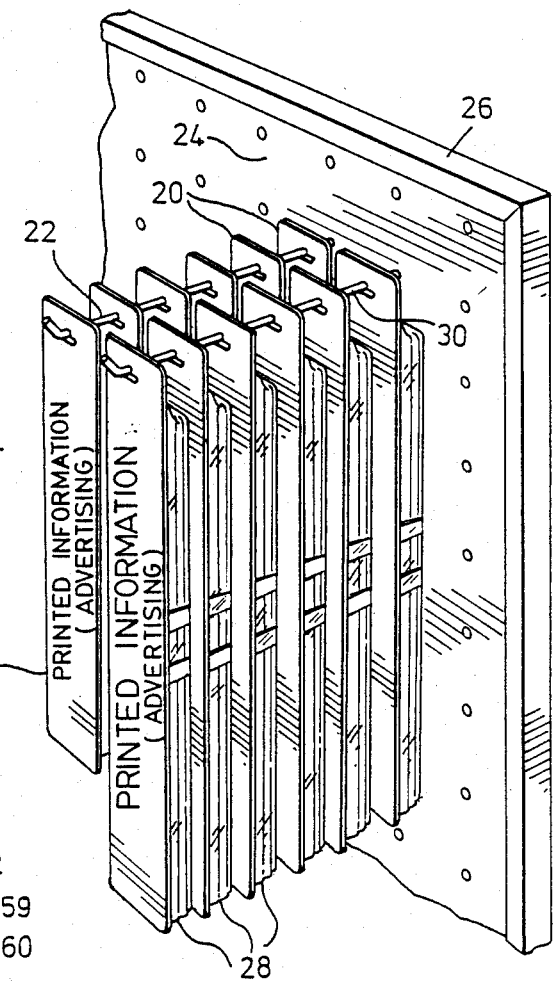
FIG. 1 is a perspective view of a plurality of blister packages made according to the invention and suspended from a conventional wall rack to display the packages.

Reference is made firstly to FIG. 1 which illustrates generally the conventional use of an exemplary blister package. As seen in FIG. 1, a plurality of blister packages 20 are suspended from a hanger 22 supported from pegboard 24 of a display wall 26. Different packages 28, also made according to the invention, are suspended from a second hanger 30 attached to the pegboard 24. In the example shown, the packages 20 contain a first size of wiper blade and the packages 24 a longer wiper blade. These packages are exemplary and will of course vary in shape and size depending upon the product to be contained. Also, it is preferred in marketing wiper blades to arrange the packaging so that the transparent blister faces the wall 24 and the flat side formed on the substrate is printed and facing potential purchasers. Anyone interested in purchasing can lift the package off the hanger and inspect the product visually through the blister. This arrangement is considered to provide enhanced point-of-sale appearance and, although not essential, it is preferred in this example.

Figure 2:
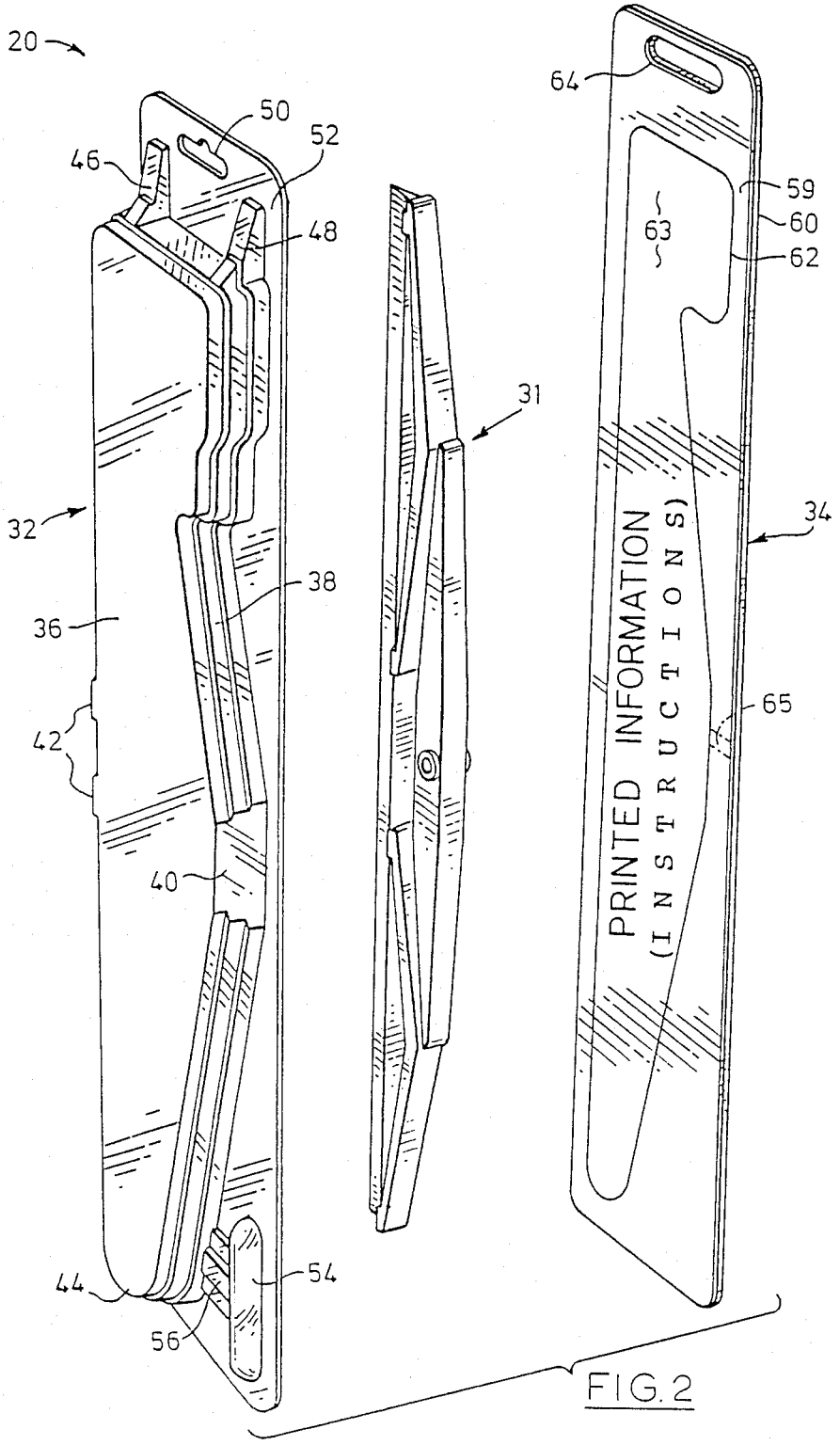
FIG. 2 is an exploded perspective view of one of the packages drawn to a larger scale and showing an exemplary product to be contained in a blister forming part of the package.

Reference is next made to FIG. 2 which illustrates one of the packages 20 before assembly to contain an exemplary wiper blade 31. The package consists essentially of a blister designated generally by the numeral 32 and substrate 34. The blister has a main cavity 36 including a stepped side wall 38 which follows generally the contour of the wiper blade. The wall is interrupted by a flat portion 40 which, because it meets the step portion 38, defines a rigid structure to strengthen the wall. Similarly, and as will be described with reference to FIG. 5, a pair of buttresses 42 are provided on the opposite side of the cavity to strengthen the wall in this portion also, and a further pair of buttresses 46, 48 are provided to reinforce the upper extremity of the cavity 36 and to strengthen the finished package in the portion used to suspend the package on the hanger 22 (FIG. 1).

A peripheral flange 52 extends in a common plane about the cavity 36 and terminates at the top end of the blister 32 in a header generally indicated by numeral 58. This header will be described more fully with reference to FIG. 3. A cut-out 50 is formed in the flange 52 in the area of the header 58 and, in use, receives the hanger 22 (FIG. 2) for suspending the package 20.

The other end of the cavity 36 is rounded at 44 for strength and also to provide a bearing surface for the wiper blade 31 which will rest on this portion of the side wall when the package is suspended.

A portion of the flange is interrupted to define a secondary cavity 54 which is connected to the main cavity 36 by a corrugation 56 which helps to strengthen the flange and connects the cavities to prevent isolation of the secondary cavity on first opening the package.

The secondary cavity is used for parts which are supplied with the wiper blade 30 and which, for simplicity, are not shown in the drawings.

The substrate 34 is made up of at least two layers which are readily delaminated. A first layer 59 forms an inner surface and the outer surface is formed by a second layer 60. As will be more fully described with reference to FIG. 3, the substrate 34 is shaped to be essentially coextensive with the blister 32 but in fact deviates in some places to prevent premature delamination of the substrate. As seen in FIG. 2, the surface of the first layer is interrupted by a score line 62 about an area 63. The score line 62 follows generally the contour of the main cavity 36 and penetrates the first layer 59 of the substrate so as to preserve the integrity of the area 63 and any instructions printed on the substrate in this area. This first layer is preferably heat sensitive so that it can be heat sealed to the blister 32 to contain the wiper blade 31.

The substrate 34 also defines a cut-out 64 for registration generally with the cut-out 50 of the blister 32 as will also be described with reference to FIG. 3.

It will be clear that the score line will make it impossible to delaminate the first and second layers in the area 63 by starting the delamination at an edge of the substrate. This is because as the delamination spreads towards the area 63, it will meet the score line 62 and fail to pull the first layer contained inside the score line from the second layer.

Consequently, when the package is pulled apart, the portion of the first layer surrounding the area 63 will remain attached to the blister and when the second layer is pulled from the first layer, it will carry with it the area 63 containing information needed by the user to install the wiper blade. This ensures that the user is not confronted with an area which is torn and which must be put together to ascertain what is in the printed material.

The substrate 34 is attached to the peripheral flange 52. However, this attachment is preferably interrupted at an area 65 shown in ghost outline. This ensures that after assembly air can pass into and from the blister for pressure equalization. This feature is particularly useful when the package is assembled and then air freighted.

Figure 3:
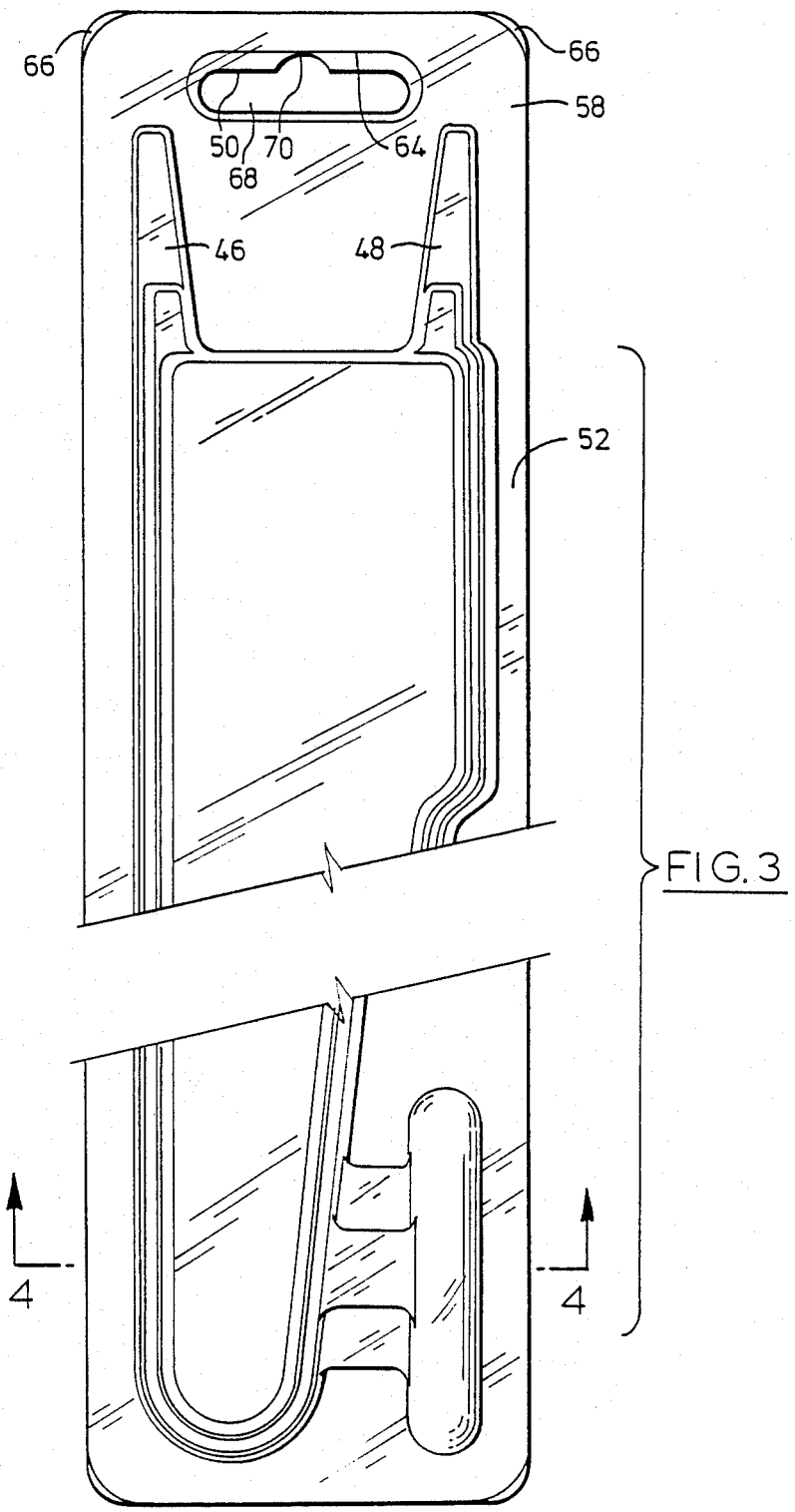
FIG. 3 is a view looking at the blister side of the package, this view being to a larger scale than that used in FIG. 2 and interrupted to show the top and bottom portions of the package.

Reference is next made to FIG. 3 which illustrates the structures of corners 66 of the package as well as the structure surrounding an opening 68 from which the package is suspended on hanger 22 (FIG. 1). It will be seen by comparing FIGS. 2 and 3 that the radii provided on the corners of the blister are smaller than those provided at the corners of the substrate. When the package is assembled, the edges of the blister and substrate are essentially coextensive but for the corners where the smaller radius of the blister results in the blister projecting beyond the substrate by a small amount. This helps to prevent premature delamination of the substrate caused by handling and by the corner rubbing against other packages, the wall, etc. Similarly, the opening 68 is bordered by the cut-outs in the blister and substrate and again, by comparison with FIGS. 2 and 3, it will be seen that the cut-out in the blister is smaller than that in the substrate. Consequently, the edges of the cut-out in the blister essentially define the extent of the opening 68. It will also be seen in FIG. 3 that the blister cut-out is shaped with a recess 70 proportioned so that its upper extremity (when suspended) meets the periphery of cut-out 64. A hanger (not shown) will then be in contact as near as possibly with both the blister and the substrate for maximum supporting strength at this point.

The relationships between the blister and the substrate, together with the use of the buttresses 46, 48 on the header 58, result in a strengthened package which is less susceptible to damage prior to sale. The buttresses limit the possibility of the header being bent out of alignment with resulting damage to the substrate and possible delamination.

Figure 4:
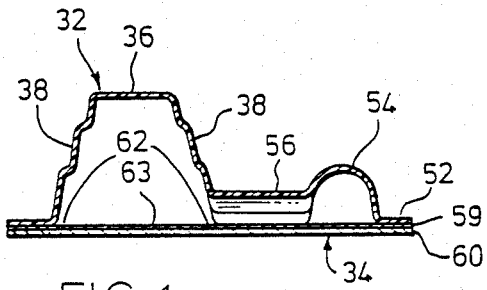
Figure 5:
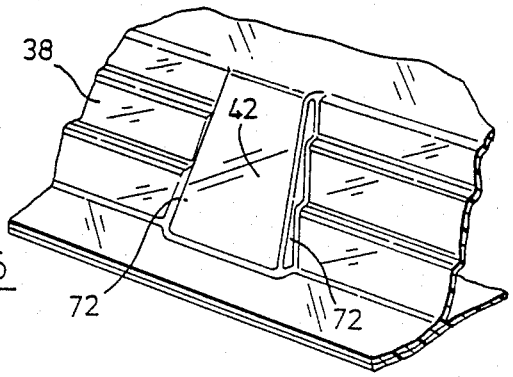
FIG. 5 (also drawn adjacent FIG. 1) is a perspective view of a portion of the package showing a buttress reinforcing a wall of the blister.

Further details of the package will now be described with reference to FIGS. 4 and 5. As seen in FIG. 4 (which is an exemplary cross-section) the stepped side wall 38 of the main cavity 36 is provided with parallel ribs which strengthen this wall and minimize the risk of it being deflected inwardly. Also, if it is pushed inwardly, the strength is such that it will tend to rebound back to its original shape. Similarly, the secondary cavity 54 is shaped for strength to minimize the possibility of permanent deformation prior to sale. For similar reasons, and as seen in FIG. 5, the buttress 42 is provided in the side wall 38 and effectively forms a discontinuity having side portions 72 which meet the side wall and strengthen it against deflection inwardly. Again, the arrangement is such that any deflection would tend to rebound back to the original shape because of the enhanced strength provided by the steps in the side wall combined with the buttresses.

Figure 7:
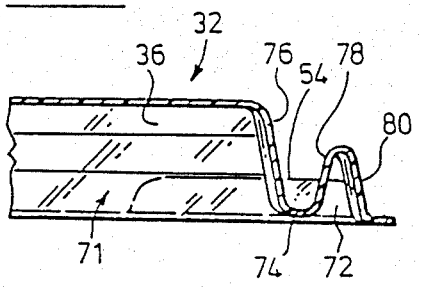
FIG. 7 (drawn adjacent FIG. 6) is a sectional view on line 7—7 of FIG. 3.
Figure 6:
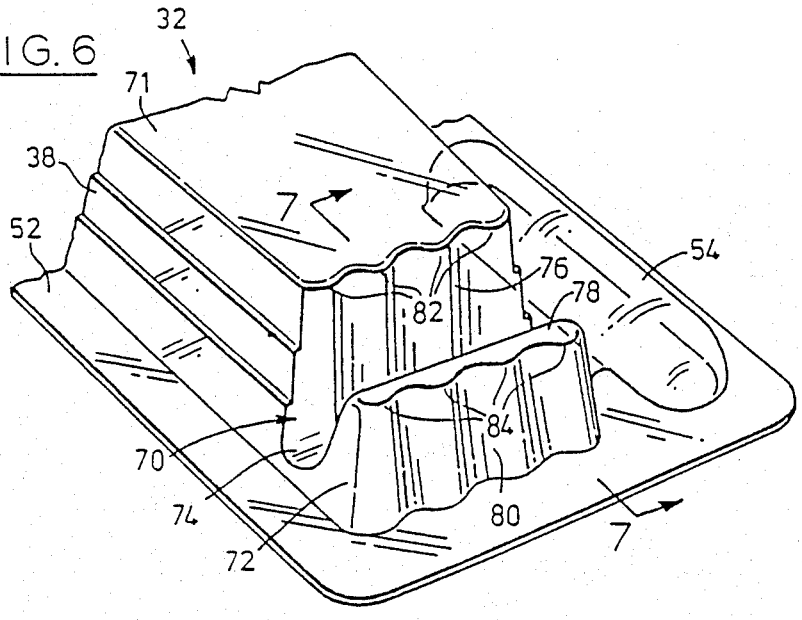
FIG. 6 is a perspective view looking at the blister side of an alternative embodiment of a package made according to the invention, this view being to a larger scale than that used in FIG. 2 and showing the bottom end of the package.

It will be appreciated that the package can be modified in many ways within the principles described with reference to the embodiment described above. For example, the bottom end of the blister may be modified to comprise a shock-absorbing structure. Such an embodiment is illustrated in FIGS. 6 and 7 and is described below with reference to these figures. For simplicity, like parts in these drawings are identified by like numerals.

A fold 70 divides the cavity 36 into a primary pocket 71 (FIG. 7) containing the wiper and a small empty secondary pocket 72. The fold 70 comprises a curved connecting portion 74 located between the primary pocket 71 of cavity 36 and the secondary pocket 72. The portion 74 connects an inclined end wall 76 of the primary pocket to a shorter first wall 78 of the secondary pocket 72 and lies adjacent to the substrate 34.

In this way, the aforementioned walls 76 and 78 diverge away from the substrate and are resiliently movable between a relatively unstable first position in which they are compressed towards each other and a relatively stable second position (as drawn) in which they are spaced from each other. Because of this resiliency, the fold 70 behaves like a shock absorber and cushions any impacts from the wiper 31.

Moreover, it will be appreciated that three layers of the material composing the blister 32 must be penetrated by the wiper 31 before rupture of the package 20 will result in the wiper protruding beyond the extremity of the substrate.

To further improve the strength and resilience of the bottom end of the blister 32, the wall 76 of the primary pocket 71 and a second wall 80 opposite to the first wall 78 of the secondary pocket 72 are each provided with a set of parallel, ribs 82 and 84 respectively which extend away from the substrate. The ribs 82, 84 also minimize the risk of the walls being deflected inwardly and the strength of the walls 76, 80 is such that they will tend to rebound back to their original shape.

In use the walls 76, 78 will be in the positions shown in the Figs., and particularly FIG. 4. Should the package be dropped on the bottom end (as drawn in FIG. 1) the product will create an impact loading initially on the inside of wall 76. Some resilient deformation will take place as the ribs 84 deform and further energy will be absorbed by this wall being pushed towards the end of the package. As this happens, the connecting portion 74 and wall 78 will be deformed and there will also be a tendency for the substrate to be pushed out of its planar shape. All of these movements absorb impact energy. If more energy is stored, the wall 76 may be broken and in very extreme conditions the wall 78 may also be broken. However, under normal conditions, no further breakage will occur resulting in the package remaining in acceptable condition for display.

Still further modifications, as will occur to those who are skilled in the art, can be made to the package without departing from the claimed scope of the invention. In particular, the relative depths of the primary and secondary pockets and the number thereof can be changed as desired. In general, the more materials used to form the walls 76, 78, the greater will be the shock-absorbing characteristics.

Further, blister can be shaped to take a variety of products and the substrate arranged with score lines to contain information in a variety of ways including, of course, multiple panels as opposed to a single area 63 shown in FIG. 2.

The preferred material for the blister is 10 mil polyvinylchloride and the substrate is preferably bleached sulphite board (20 point) coated on the outer surface with a high heat seal varnish and on the inner surface with polyvinylchloride. The substrate is scored lightly to penetrate the polyvinylchloride coating without showing through on the other side of the substrate. Different materials could be used consistent with being able to attach one to the other either by heat sealing or adhesive.

The embodiments of the invention in which an exclusive property or privilege is claimed are defined as follows:

1. A package for displaying a product, the packaging comprising:

a transparent blister defining a main cavity for containing the product and a peripheral flange lying in a plane about the cavity;

a laminated substrate proportioned so that the blister and the substrate have substantially coextensive peripheries, the substrate being readily delaminated and having a first layer attached permanently to the flange and defining an inner surface, and a second layer defining an outer surface, the inner surface of the first layer having an area in registration with the cavity and printed with information to be retained for use by a purchaser after opening the package and a score line penetrating the first layer at the edge of said area, and the outer surface being uninterrupted and carrying promotional information, so that on opening the package by delamination, the substrate will separate about said area by delamination and the score line will interrupt the delamination leaving the area attached to the second layer and available intact for the user to inspect the printed information on said area.

2. A package as claimed in claim 1 and further comprising a header made up of portions of the flange and the substrate, the header defining an opening for suspending the package from a projection engaged through the opening.

3. A package as claimed in claim 1 and further comprising at least one secondary cavity in the blister.

4. A package as claimed in claim 1 in which the main cavity corresponds in shape to the shape of the product to be contained in the package.

5. A package as claimed in claim 1 in which the main cavity has a side wall made up of a plurality of steps to rigidify the wall.

6. A package as claimed in claim 1 in which the main cavity includes at least one buttress extending from the cavity and terminating at the flange to rigidify the package against bending forces.

7. A package as claimed in claim 1 in which the package has at least one corner and in which the corner is rounded and defined by the flange, the substrate being cut back in the region of said corner to allow the flange to project slightly beyond the substrate to protect the substrate from forces which could delaminate the substrate and thereby detract from the appearance of the package.

8. A package as claimed in claim 1 in which the blister and substrate meet at an area of the flange where the blister is not attached to the substrate to permit pressure equalization between the cavity and ambient air.

9. A package for displaying a product, the package comprising:

a transparent blister defining a main cavity for containing the product and a peripheral flange lying in a plane about the cavity;

a laminated substrate proportioned so that the blister and the substrate have substantially coextensive peripheries, the substrate being readily delaminated and having a first layer attached permanently to the flange and defining an inner surface, and a second layer, defining an outer surface, the inner surface of the first layer having an area in registration with the cavity and printed with information to be retained for use by a purchaser after opening the package and a score line penetrating the first layer at the edge of said area, and the outer surface being uninterrupted and carrying promotional information, so that on opening the package by delamination, the substrate will separate about said area by delamination and the score line will interrupt the delamination leaving the area attached to the second layer and available intact for the user to inspect the printed information on said area;

a header made up of portions of the flange and the substrate, the header defining an opening for suspending the package from the projection engaged through the opening, and the main cavity including two buttresses spaced apart and extending to the header at either side of the opening to rigidify the header against bending forces.

10. A package as claimed in claim 9 in which the opening is formed by a first cut-out in the flange and a second cut-out in the substrate, the first cut-out being smaller than the second cut-out so that the opening is bordered by the flange.

11. A package for displaying a product, the package comprising:

a transparent blister defining a main cavity for containing the product and a flange lying in a plane about the product and defining side edges of which at least two edges converge to define a first rounded corner having a selected first radius; and a substrate attached to the blister at the flange and having side edges in registration with the corresponding side edges of the blister, the substrate having a second rounded corner corresponding to the first rounded corner and defined by two converging side edges of the substrate, the second rounded corner having a second radius larger than the first radius so that at this corner of the package the blister extends outwardly beyond the substrate a distance sufficient to protect the substrate against forces which would tend to damage the substrate and thereby detract from the appearance of the package.

12. A package as claimed in claim 11 in which the package is rectangular and in which all four corners of the blister are rounded and have said selected first radius and all four corners of the substrate are rounded and have said second radius to protect the substrate at all four corners.

13. A package for displaying a product, the package comprising:

a transparent blister defining a main cavity for containing the product and a flange lying in a plane about the cavity, and defining a peripheral edge;

a substrate attached to the blister at the flange and having an edge substantially coextensive with said peripheral edge;

a header having two rounded corners formed by portions of said flange and said substrate and defining an opening for suspending the package from a hanger; and two buttresses formed as part of the cavity and extending across at least part of the header to either side of the opening to rigidify the header against bending forces; and the blister having two rounded corners of a selected first radius corresponding to the corners of the header so that at these corners, the blister extends outwardly beyond the substrate a distance sufficient to protect the substrate against forces which would tend to damage the substrate at the corners.

14. A package as claimed in claim 13 in which the opening is defined by cut-outs in the flange and substrate, the cut-out in the substrate being larger than the cut-out in the flange.

15. A package for displaying a product, the package comprising:

a transparent blister defining a main cavity for containing the product and a flange lying in a plane about the product and defining side edges of which at least two edges converge to define a first corner; and a substrate attached to the blister at the flange and having side edges in registration with the corresponding side edges of the blister, the substrate having a second corner corresponding to the first corner defined by converging side edges of the substrate, the second corner being dimensioned so that at this corner of the package, the blister extends outwardly beyond the substrate a distance sufficient to protect the substrate against forces which would tend to damage the substrate and thereby detract from the appearance of the package.

16. A package for displaying a product, the package comprising:

a transparent blister defining a main cavity for containing the product and a flange lying in a plane about the cavity, and defining a peripheral edge;

a substrate attached to the blister at the flange and having an edge substantially coextensive with said peripheral edge;

a header formed by a portion of said flange and said substrate and defining an opening for suspending the package from a hanger, the opening being formed by a first cut-out in the flange and a second cut-out in the substrate, the first cut-out being smaller than the second cut-out so that the opening is bordered by the flange; and two buttresses formed as part of the cavity and extending across at least part of the header to either side of the opening to rigidify the header against bending forces and to thereby minimize the risk of damage to the package caused by potential purchasers handling the package.

* * * * *